US008025018B2

(12) United States Patent
Dhellemmes et al.

(10) Patent No.: US 8,025,018 B2
(45) Date of Patent: Sep. 27, 2011

(54) FASTENING OF INSULATING BLOCKS FOR A LIQUEFIED GAS TRANSPORT TANK BY ADHESIVE BONDING USING WAVY BEADS OF ADHESIVE

(75) Inventors: Jacques Dhellemmes, Versailles (FR); Gery Canler, La Celle les Bordes (FR)

(73) Assignee: Gaztransport et Technigaz, Saint-Remy-les-Chevreuse (FR)

( * ) Notice: Subject to any disclaimer, the term of this patent is extended or adjusted under 35 U.S.C. 154(b) by 545 days.

(21) Appl. No.: 11/947,871

(22) Filed: Nov. 30, 2007

(65) Prior Publication Data

US 2008/0127880 A1 Jun. 5, 2008

(30) Foreign Application Priority Data

Nov. 30, 2006 (FR) ..... 06 55209

(51) Int. Cl.
*B63B 25/08* (2006.01)

(52) U.S. Cl. ..... 114/74 A; 220/901

(58) Field of Classification Search ..... 220/901, 220/560.04, 560.12–560.15; 114/74 A, 74 R; 156/290, 291

See application file for complete search history.

(56) References Cited

U.S. PATENT DOCUMENTS

| | | | | |
|---|---|---|---|---|
| 5,501,359 | A | 3/1996 | Chauvinh et al. | |
| 5,586,513 | A | 12/1996 | Jean et al. | |
| 5,958,337 | A * | 9/1999 | Bourne et al. | 422/26 |
| 6,374,761 | B1 * | 4/2002 | Dhellemmes | 114/74 A |
| 7,024,748 | B2 | 4/2006 | Eagles | |
| 2006/0117566 | A1 | 6/2006 | Yang et al. | |

FOREIGN PATENT DOCUMENTS

| | | |
|---|---|---|
| FR | 2 265 608 | 10/1975 |
| FR | 2 691 520 | 11/1993 |
| FR | 2 724 623 | 3/1996 |
| FR | 2 798 902 | 3/2001 |
| JP | 63181859 | 7/1988 |
| JP | 07-37125 | 7/1995 |
| JP | 8207883 | 8/1996 |
| JP | 2001081417 | 3/2007 |
| TW | 051494 | 7/1983 |
| TW | 590957 | 6/2004 |

OTHER PUBLICATIONS

French Search Report, Jul. 25, 2007.
JP Office Action dated Sep. 7, 2010, from corresponding JP2007-283447, English translation included.
TW Office Action dated Oct. 27, 2010, from corresponding TW096140098, English translation included.
Japanese Office Action—Application No. 2007-283447 dated Jun. 15, 2011.

* cited by examiner

*Primary Examiner* — Edwin Swinehart
(74) *Attorney, Agent, or Firm* — Young & Thompson

(57) ABSTRACT

Method of adhesively bonding second insulating blocks to a ship's inner hull using beads of mastic for the production of a sealed, thermally insulating tank for the transportation of liquefied gases, the tank having two successive sealing barriers alternated with two insulating barriers of first and second insulating blocks produced from plywood panels and containing or carrying thermally insulating materials, the second insulating blocks of the secondary insulating barrier being fastened directly against the inner hull, the method including applying beads of mastic to the lower face of the panels of the second insulating blocks along mutually parallel lines, positioning the second insulating blocks against the inner hull, and pressing thereof against the inner hull until polymerization of the mastic, wherein at least two of the beads on the lower face of at least one panel of the second insulating blocks are arranged along wavy parallel lines.

11 Claims, 4 Drawing Sheets

FASTENING OF INSULATING BLOCKS FOR A LIQUEFIED GAS TRANSPORT TANK BY ADHESIVE BONDING USING WAVY BEADS OF ADHESIVE

The field of the present invention is that of producing sealed, thermally insulating tanks built into a bearing structure, in particular the hull of a ship intended for the sea transportation of liquefied gases and, in particular, for the transportation of liquefied natural gases having a high methane content.

French patents 2 265 603, 2 798 902, 2 683 786, 2 691 520 and 2 724 623 have already described the production of a sealed, thermally insulating tank of this type, the said tank consisting of two successive sealing barriers alternated with two thermal insulation layers called insulating barriers. A first sealing barrier, termed primary sealing barrier, is in contact with liquefied gas while a second sealing barrier, termed secondary sealing barrier, is arranged between the two insulating barriers. The various barriers are fastened to one another and the secondary insulating barrier is fastened to the inner hull of the ship using various methods known to a person skilled in the art.

In these embodiments, the primary and secondary insulating barriers consist of a succession of insulating blocks which are either closed parallelepipedal caissons filled with a heat insulator or consist of insulating foam blocks adhesively bonded to a carrier panel. The material used to produce the panels of the caissons or the carrier panels is generally plywood, for reasons of cost and for its insulating qualities. However, one of the drawbacks with plywood is that it is anisotropic and that its mechanical properties differ according to whether a stress is exerted in the direction of, or else transversely to, the grain of its outer plies.

The insulating blocks are fastened to the inner hull, in the first case by assembly with the aid of studs incorporated in the inner hull and, in the second case, by being quite simply adhesively bonded, via their outer panel, to the said surface. In that case, the material used for the adhesive bonding is generally an epoxy resin mastic which is deposited in the form of beads on that face of the insulating block which is placed facing the inner hull. In the prior art the beads are arranged rectilinearly on the panels of the insulating blocks, parallel to one another.

The function of these beads of mastic, apart from maintaining the insulating block on the inner hull, is to compensate for the inevitable irregularities of this hull by adapting to its shape. During the mounting operation, the insulating block is positioned on the inner hull with the aid of known means such that the beads of mastic are compressed, prior to polymerization, against the inner hull and thus perfectly follow its shape. It is thus a certainty that high-quality adhesive bonding will be obtained. With the polymerization the beads of mastic cure and then behave as perfectly rigid materials.

Since the forces originating from within the tank are transmitted to the inner hull via the panels of the insulating blocks, these panels need to withstand the pressures and tensile stresses which are applied to them without the structure of the plywood being ruptured. It is therefore necessary not to space the beads of mastic too far apart from one another and thus prevent forces being applied to the wood at too large a distance from a bead.

Moreover, the multiplicity of beads has the disadvantage of significantly increasing the cost of producing the tank of a ship transporting liquefied gas, owing to the large quantity of mastic that is needed. The beads must, on the one hand, have a relatively large cross section so as to compensate for the irregularities of the inner hull and, on the other hand, the total length of the beads, if they were placed end to end, would amount to several tens of kilometers, or even around a hundred kilometers, for an average-sized ship.

The object of the present invention is to overcome these disadvantages by providing a less expensive method of adhesively bonding insulating blocks to the inner hull using beads of mastic, while at the same time retaining a strong resistance of the panels of the said insulating blocks to the compressive or tensile forces which are exerted on them, or even improving this resistance.

Accordingly, the subject of the invention is a method of adhesively bonding second insulating blocks to a ship's inner hull using beads of mastic, preferably epoxy resin mastic, for the production of a sealed, thermally insulating tank for the transportation of liquefied gases, the said tank consisting of two successive sealing barriers, a primary sealing barrier in contact with the product contained in the tank and a secondary sealing barrier situated between the primary sealing barrier and the inner hull of the ship, these two sealing barriers being alternated with two insulating barriers consisting of first and second insulating blocks produced from plywood panels and containing or carrying thermally insulating materials, a first barrier, termed primary insulating barrier, being carried by the secondary sealing barrier and supporting the primary sealing barrier, and a second barrier, termed secondary insulating barrier, supporting the secondary sealing barrier and of which the said second insulating blocks are fastened directly against the inner hull, the said method comprising the application of beads of mastic to the lower face of the panels of the said second insulating blocks along mutually parallel lines, the positioning of the said second insulating blocks against the inner hull of the ship, and the pressing thereof against the said inner hull until polymerization of the said mastic, characterized in that at least two of the said beads on at least one panel of the said second insulating blocks are arranged along wavy parallel lines.

Advantageously, the distance between two consecutive wavy lines is greater than or equal to 100 mm.

Preferably, the wavy lines are sinusoids.

Advantageously, the sinusoid has a ratio substantially equal to 8 between its period and its amplitude.

Another subject of the invention is a sealed, thermally insulating tank built into the inner hull of a ship and consisting of two successive sealing barriers, a primary sealing barrier in contact with the product contained in the tank and a secondary sealing barrier situated between the primary sealing barrier and the inner hull of the ship, these two sealing barriers being alternated with two insulating barriers consisting of first and second insulating blocks produced from plywood panels and containing or carrying thermally insulating materials, a first barrier, termed primary insulating barrier, being carried by the secondary sealing barrier and supporting the primary sealing barrier, and a second barrier, termed secondary insulating barrier, supporting the secondary sealing barrier and of which the said second insulating blocks are fastened directly against the inner hull of the ship by means of beads of mastic, preferably epoxy resin mastic, positioned on the lower face of the panels of the said second insulating blocks along mutually parallel lines, characterized in that at least two of the said beads on at least one panel of the said second insulating blocks are arranged along wavy parallel lines.

Advantageously, the distance between two consecutive wavy parallel lines is greater than or equal to 100 mm.

Preferably, the wavy lines are sinusoids.

Advantageously, the sinusoid has a ratio substantially equal to 8 between its period and its amplitude.

The invention will be better understood and other objects, details, features and advantages thereof will become more clearly apparent in the course of the following detailed explanatory description of an embodiment of the invention that is given by way of purely illustrative and non-limiting example with reference to the appended schematic drawings, in which.

Figure 1:
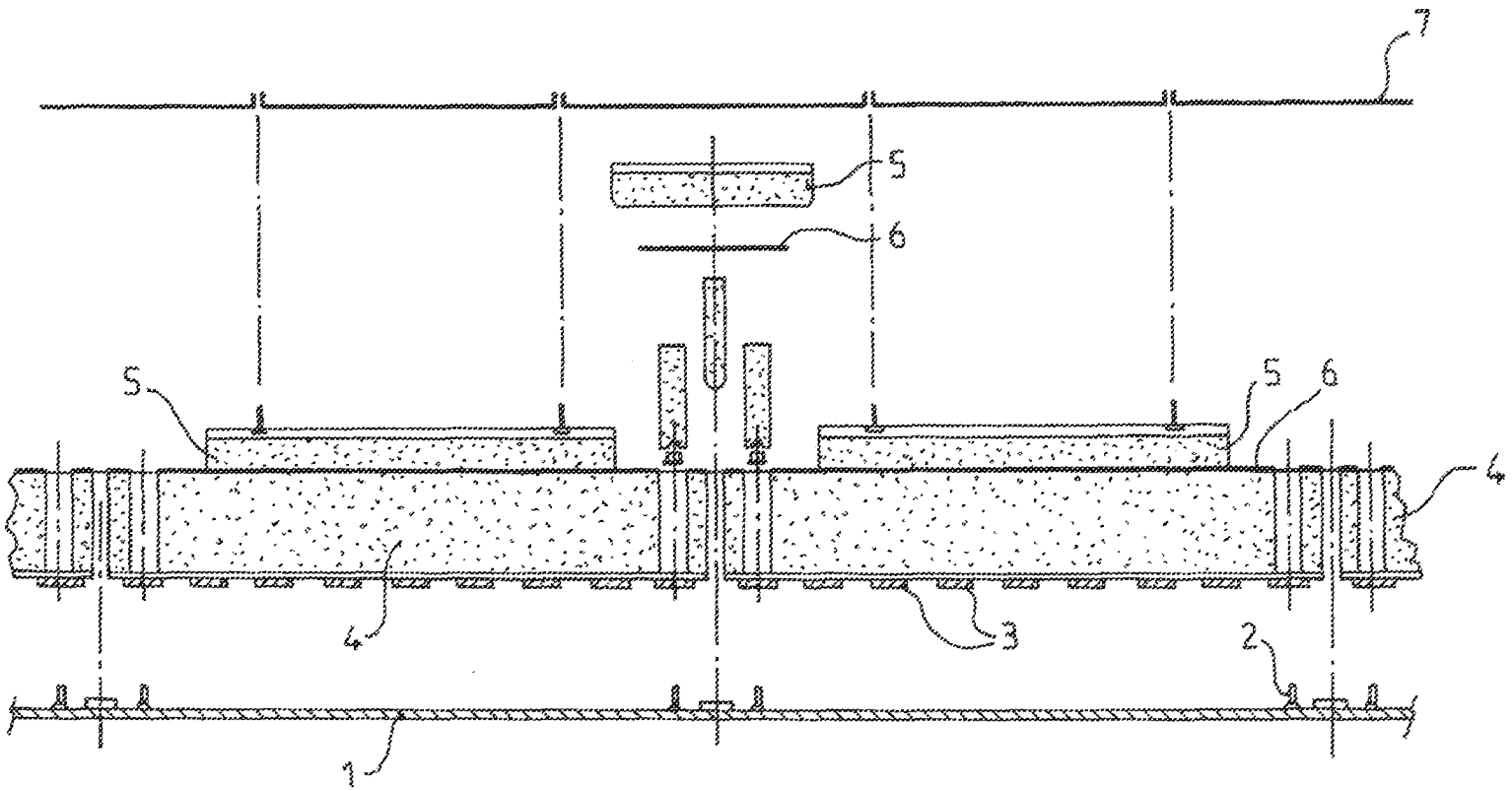
FIG.1 PRIOR ART
FIG. 1 is a sectional view of an insulating system comprising two sealing barriers and two insulating barriers according to one embodiment of the prior art.

With reference to FIG. 1, there can be seen the inner hull 1 of a ship for transporting liquefied gas, to which hull have been fastened studs 2 which are intended to keep second insulating blocks 4 in place during their installation, these blocks being produced as foam blocks placed on a carrier panel so as to constitute a secondary insulating barrier. These second insulating blocks 4 are fastened to the inner hull 1 by beads of mastic 3 arranged on the lower face of their carrier panel, transversely to the largest dimension of the second insulating block, and kept in contact with the inner hull 1 during their installation by way of fastening means cooperating with the studs 2. (NB: for linguistic convenience, it is appropriate to refer from now on to the lower face of the second insulating block or of its carrier panel as the face which is situated opposite the inner hull, whether the second insulating block is intended to be placed on the floor, on the ceiling or on a side wall of the hull.)

The secondary insulating barrier consisting of the second insulating blocks 4 is covered, in the direction towards the centre of the tank, and using fastening means (not shown), by a secondary sealing barrier 6, itself covered by a primary insulating barrier. This primary insulating barrier consists, in the same way as the secondary insulating barrier, of first insulating blocks 5 to which a primary sealing barrier 7 in contact with the liquefied gas is fastened.

Figure 2:
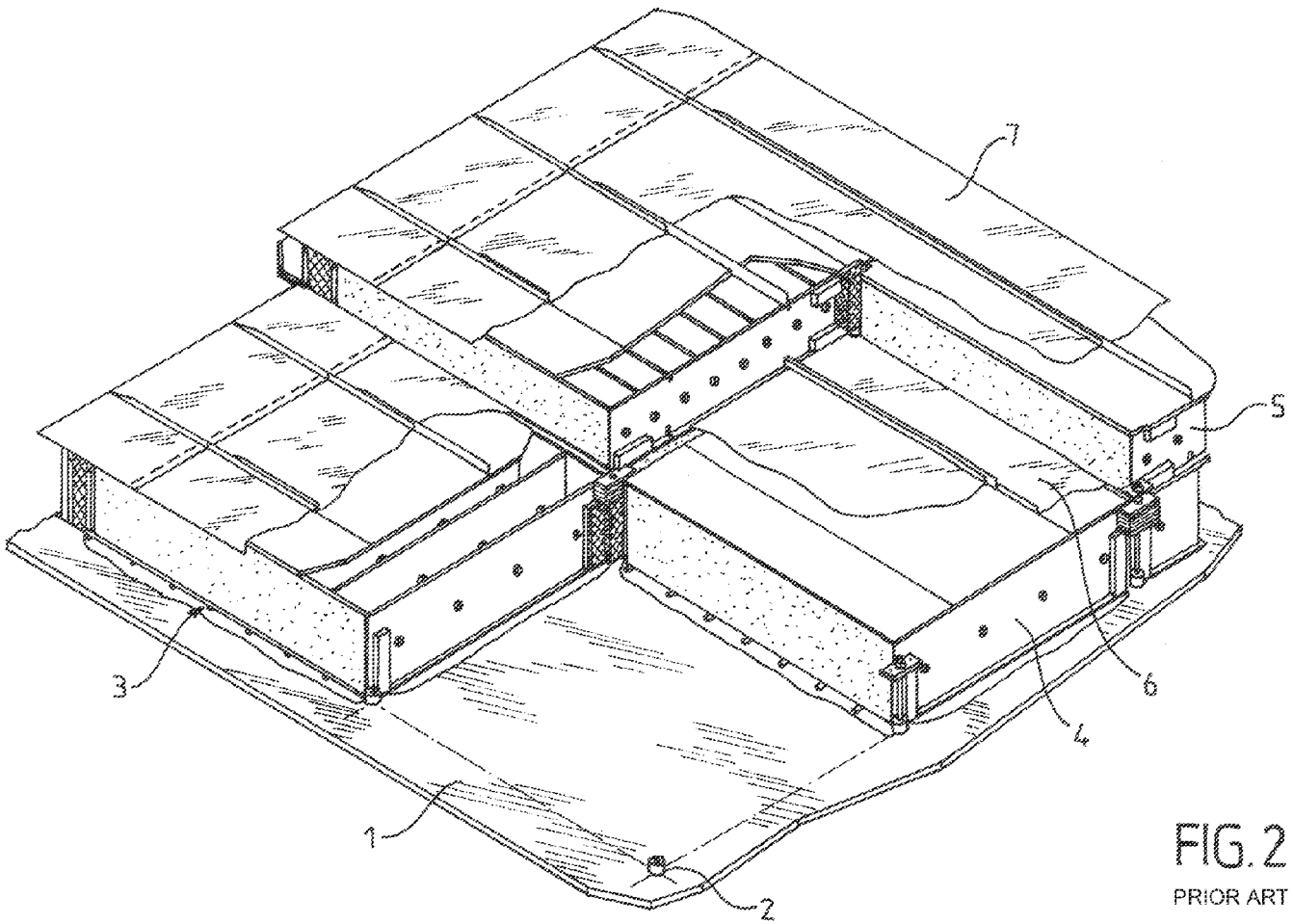
FIG. 2 PRIOR ART
FIG. 2 is a perspective view of the same insulating system according to another embodiment of the prior art.

With reference to FIG. 2, there can be seen another embodiment of the prior art in which the insulating barriers are produced with the aid of first and second insulating blocks produced in the form of closed parallelepipedal caissons which are made of plywood and contain a heat-insulating product, such as perlite. Starting from the inner hull 1, there again appear the second insulating blocks 4 of the secondary insulating barrier, the secondary sealing barrier 6, the first insulating blocks 5 of the primary insulating barrier, and the primary sealing barrier 7. The second insulating blocks 4 are positioned on the inner hull 1 during their installation via fastening means 2 and then adhesively bonded to this inner hull by beads of mastic 3 arranged beforehand on their lower part, transversely with respect to the largest dimension of the second insulating blocks.

Figure 3:
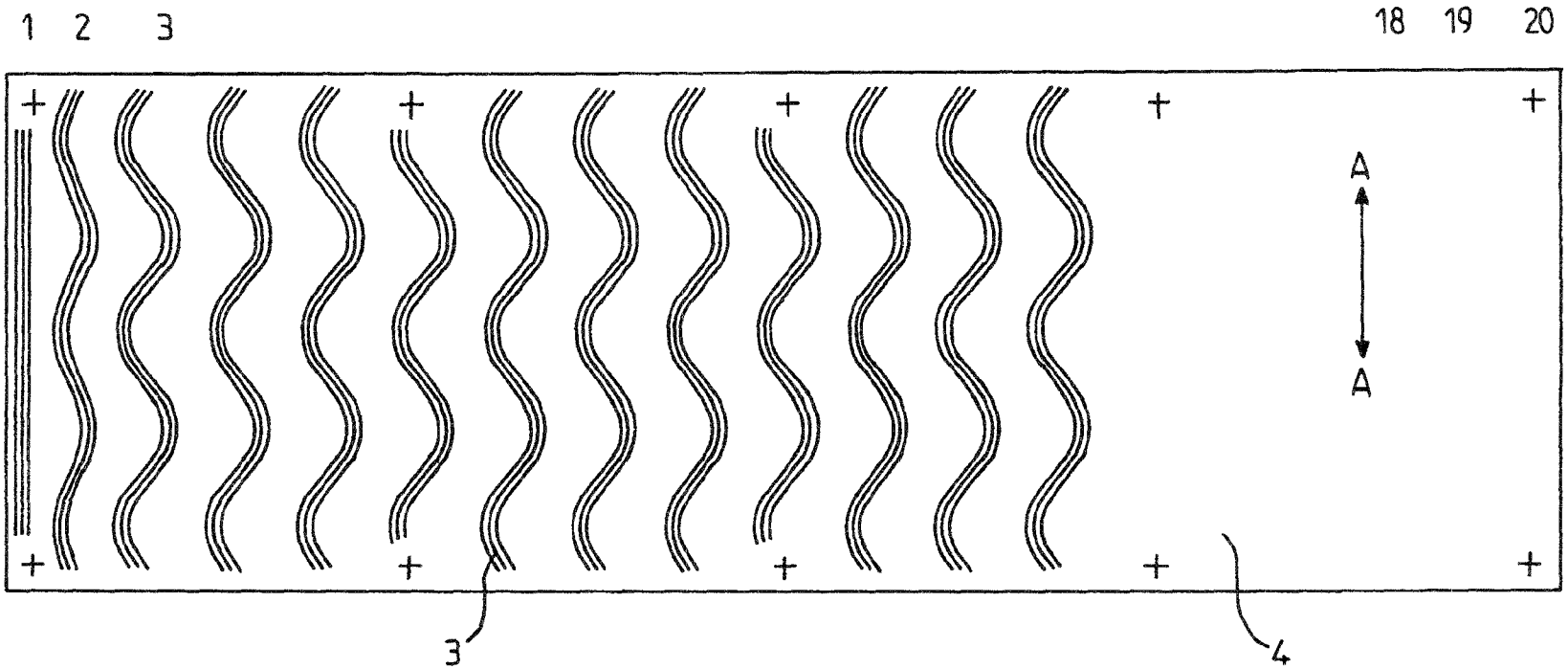
FIG. 3 is a bottom view of a second insulating block according to an embodiment of the invention.

With reference to FIG. 3, there can be seen a bottom view of a panel of a second insulating block 4 on which beads of mastic 3 according to the invention have been arranged, transversely to the largest dimension of the second insulating blocks. Owing to the method of constructing plywood panels, there is always an uneven number of plies and the wood grain on the outer plies is oriented along the axis of the smallest dimension of the panel. This orientation is represented by the axis A-A in FIG. 3.

Figure 4:
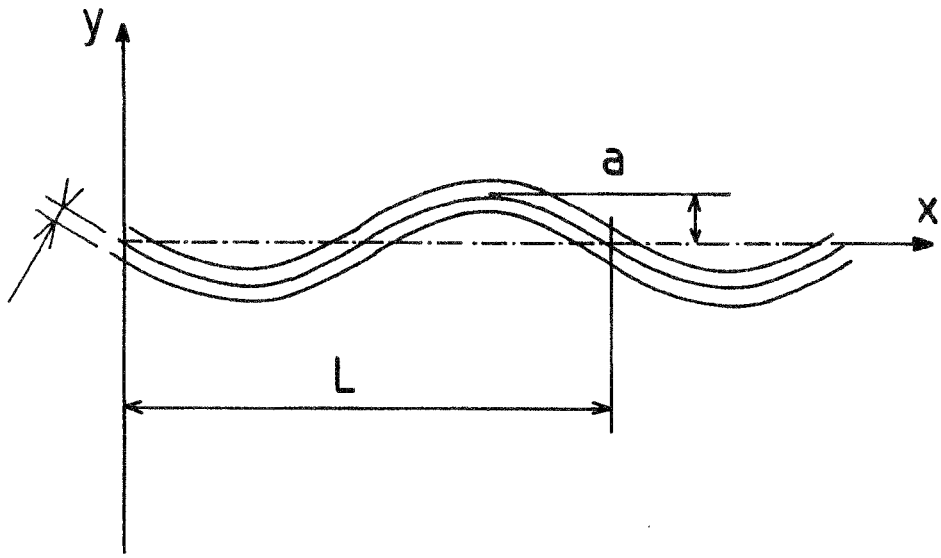
FIG. 4 is a view of a detail of the form of a bead of mastic according to an embodiment of the invention.

With reference to FIG. 4, there can be seen a detail of the shape of a bead of mastic according to the invention wherein the wavy shape shown is a sinusoidal shape of period "L" and amplitude "a".

The gain afforded by the invention over the prior art will now be described.

In the prior embodiments, the beads of mastic are rectilinear and spaced regularly apart by a length which varies according to the location where the corresponding second insulating block will be placed in the tank, in other words according to the pressure to which it will be subjected. In the case of the tank bottom walls (floor and lower parts of the side walls), it is necessary to bring the beads of mastic closer together to prevent the wood from rupturing between two beads. A spacing of 100 mm is generally adopted between two consecutive beads on the same second insulating block. In those regions where the pressure to be borne will be less (upper parts of the side walls, and ceiling), a looser spacing is acceptable. The spacing generally adopted is then 140 mm.

The panels of wood constituting the faces of the second insulating blocks 4 are subjected in use to compressive forces owing to the weight of the liquid contained in the tank, but they must also be able to withstand tensile forces generated by the deformation of the inner hull 1 during ballasting operations.

The weak points of a plywood panel are of two types:

- in compression it may break by bending along a line parallel to the beads since the lower face, which is subjected to a uniformly distributed pressure, is supported only by the linear edges formed by the beads, with a non-supported spacing between them. This fragility is further accentuated when the beads are oriented in the same direction as the grain of the outer ply of the plywood (cf. FIG. 3), this frequently being the case in practice. This is because the yards where ships for transporting liquefied gas are built are required to manipulate the second insulating blocks equipped with their beads of mastic, in particular to turn them over so as to reposition the lower face to the bottom after the operation of depositing the mastic. This manoeuvre proceeds more reliably if the beads of mastic remain in the same plane during this rotation, in other words if they are placed in the direction of the smallest dimension of the lower face. This orientation is precisely, owing to the construction of the plywood, the direction of the grain of the outer ply;
- in tension the wood of a plywood panel may delaminate, with part of the wood of the outer ply remaining attached to the bead of mastic, the remainder separating therefrom, thus allowing the second insulating block to become detached from the inner hull.

These weaknesses of the plywood prevent too much spacing between the beads of mastic and thus prevent a reduction in the volume of mastic employed to provide the insulation for a tank.

The invention solves this problem by replacing the rectilinear beads employed beforehand with beads 3 having waves, which may, for example, be sinusoidal as shown in FIGS. 3 and 4.

Tests were conducted on panels which were equipped with sinusoidal beads, having various spacings, of which the period L is 372 mm and the amplitude a is 46.5 mm. The length of such a sinusoid, which is characterized by a ratio L/a equal to 8, is greater by 14% than that of the corresponding straight line segment of length L.

The resistance of the panels to inter-bead flexural rupture and to delamination was evaluated and compared with that of panels equipped with rectilinear beads spaced 100 or 140 mm apart. The same flexural rupture pressure is found with these sinusoidal beads only with a spacing between them that is greater by 35% than that observed with rectilinear beads.

Likewise, the delamination resistance tests showed that, with such a sinusoidal shape (ratio L/a equal to 8), the delamination resistance is increased by 48% with respect to straight beads which are themselves also placed parallel to the grain of the plywood. This means that a reduction by 35% in the length of mastic deposited on the panel of a second insulating block is possible, without the effect achieved in terms of delamination being more unfavourable than with rectilinear beads.

Overall, the use of sinusoidal beads having a ratio L/a equal to 8 allows a saving of 18% in the amount of mastic necessary by comparison with rectilinear beads, while maintaining the same flexural rupture strength and even obtaining better delamination resistance.

It is obvious that other sinusoids may be selected, with ratios L/a other than 8, or else any alternating periodic shapes (chevrons, squares, etc.). The amount of mastic necessary will be greater or lesser depending on the shape of these wavy lines. However, the spacing between the lines should be adapted so that sufficient flexural rupture resistance can be maintained with the wavy shape adopted.

Although the invention has been described in relation to a number of specific embodiments, it is obvious that it is not at all restricted thereto and that it comprises all the technical equivalents of the means described along with their combinations if these come within the scope of the invention.

The invention claimed is:

1. Method of adhesively bonding second insulating blocks (4) to a ship's inner hull (1) with beads (3) of mastic for the production of a sealed, thermally insulating tank for the transportation of liquefied gases, the tank having two successive sealing barriers, a primary sealing barrier (7) in contact with the gases contained in the tank and a secondary sealing barrier (6) situated between the primary sealing barrier and the inner hull (1) of the ship, these two sealing barriers being alternated with two insulating barriers of, respectively, first and second insulating blocks (5, 4) produced from plywood panels and containing or carrying thermally insulating materials, the two insulating barriers including a primary insulating barrier, carried by the secondary sealing barrier (6) and supporting the primary sealing barrier (7), and a secondary insulating barrier, supporting the secondary sealing barrier (6) and of which the second insulating blocks (4) are fastened against the inner hull (1), the method comprising;

a) applying beads (3) of mastic to a lower face of the panels of the second insulating blocks (4) along mutually parallel lines, wherein at least two of the beads of mastic on the lower face of at least one of the panels of the second insulating blocks are arranged along wavy parallel lines, b) positioning the second insulating blocks (4) against the inner hull (1) of the ship so that the at least two beads of mastic on the at least one panel are between the at least one panel and the inner hull, and c) pressing the at least one panel against the inner hull until polymerization of the at least two beads of mastic so that the at least one panel is fastened against the inner hull by the at least two beads of mastic, wherein the at least two beads of mastic between the at least one panel and the inner hull have a cross section suitable to compensate for irregularities of the inner hull, and wherein the lower face of the at least one panel comprises a non-supported spacing between the at least two beads of mastic.

2. Adhesive bonding method according to claim 1, in which the distance between two consecutive wavy lines is greater than or equal to 100 mm.

3. Adhesive bonding method according to claim 1, in which the wavy lines are sinusoids.

4. Adhesive bonding method according to claim 3, in which the sinusoid has a ratio substantially equal to 8 between its period and its amplitude.

5. Sealed, thermally insulating tank built into an inner hull (1) of a ship and having two successive sealing barriers, a primary sealing barrier (7) in contact with a product contained in the tank and a secondary sealing barrier (6) situated between the primary sealing barrier and the inner hull (1) of the ship, these two sealing barriers being alternated with two insulating barriers of, respectively, first and second insulating blocks (5, 4) produced from plywood panels and containing or carrying thermally insulating materials, said two insulating barriers including a primary insulating barrier carried by the secondary sealing barrier (6) and supporting the primary sealing barrier (7), and a secondary insulating barrier supporting the secondary sealing barrier (6) and of which said second insulating blocks (4) are fastened against the inner hull (1) of the ship by beads (3) of mastic positioned on a lower face of the panels of said second insulating blocks along mutually parallel lines, wherein at least two of said beads of mastic on the lower face of at least one of the panels of said second insulating blocks are arranged along wavy parallel lines, wherein the at least two beads of mastic are between the at least one panel and the inner hull and have a cross section suitable to compensate for irregularities of the inner hull, and wherein the lower face of the at least one panel comprises a non-supported spacing between the at least two beads of mastic.

6. Sealed, thermally insulating tank according to claim 5, in which the distance between two consecutive wavy parallel lines is greater than or equal to 100 mm.

7. Sealed, thermally insulating tank according to claim 5, in which the wavy lines are sinusoids.

8. Sealed, thermally insulating tank according to claim 7, in which the sinusoid has a ratio substantially equal to 8 between its period and its amplitude.

9. Ship for the transportation of liquefied gases, comprising at least one sealed, thermally insulating tank according to claim 5.

10. Sealed, thermally insulating tank according to claim 6, in which the wavy lines are sinusoids.

11. Adhesive bonding method according to claim 2, in which the wavy lines are sinusoids.

* * * * *